United States Patent [19]

Meister

[11] Patent Number: 5,001,986

[45] Date of Patent: Mar. 26, 1991

[54] SHORT-RANGE PROJECTILE CONTAINING MEANS FOR PRODUCING A SHORT FLIGHT PATH

[75] Inventor: Daniel Meister, Kloten, Switzerland

[73] Assignee: Werkzeugmaschinenfabrik Oerlikon-Buhrle AG, Zurich, Switzerland

[21] Appl. No.: 463,355

[22] Filed: Jan. 11, 1990

[30] Foreign Application Priority Data

Mar. 3, 1989 [CH] Switzerland ..... 796/89

[51] Int. Cl.[5] ..... F42B 10/48; F42B 8/00

[52] U.S. Cl. ..... 102/529; 102/498

[58] Field of Search ..... 102/529, 498, 502, 514, 102/515

[56] References Cited

U.S. PATENT DOCUMENTS

| | | | |
|---|---|---|---|
| 3,732,826 | 5/1973 | Johnson | 102/529 |
| 3,747,533 | 7/1973 | Rossmann | 102/529 |
| 3,952,662 | 4/1976 | Greenlees | 102/502 |
| 4,140,061 | 2/1979 | Campoli | 102/529 |
| 4,242,960 | 1/1981 | Boeder et al. | 102/529 |
| 4,413,566 | 11/1983 | Loeb et al. | 102/529 |

FOREIGN PATENT DOCUMENTS

| | | | |
|---|---|---|---|
| 0036232 | 9/1981 | European Pat. Off. . | |
| 0090888 | 10/1983 | European Pat. Off. | 102/529 |
| 3045129 | 6/1982 | Fed. Rep. of Germany | 102/529 |
| 3422659 | 12/1985 | Fed. Rep. of Germany . | |
| 53203 | 5/1967 | Luxembourg . | |
| 532240 | 2/1973 | Switzerland . | |
| 667723 | 10/1988 | Switzerland . | |

*Primary Examiner*—David H. Brown

*Attorney, Agent, or Firm*—Sandler, Greenblum & Bernstein

[57] ABSTRACT

Within the tactical operating distance, the projectile body in a short-range projectile ought to exhibit as far as possible the same performance characteristics as the corresponding normal or full-range projectile. To bring about the short flight path of the short-range projectile during travel of the projectile along its flight path, the following range shortening variants are applicable: (i) the projectile nose is formed of a suitable plastic material, the surface thereof being subject to considerable change under the action of air friction during flight such that the air resistance or drag increases and the flight path is shortened, particularly in the subsonic range; (ii) the projectile surface is covered or coated at least at preselected locations with a layer of suitable plastic material, such layer being subject to considerable change or erosion under the action of air friction, whereby the air resistance or drage increases and the flight path is shortened; and (iii) the projectile surface is roughened or provided with suitable grooves and smoothened by means of a layer of appropriate plastic material, such layer disappearing or disintegrating under the action of air friction during flight and the original roughened or grooved projectile surface bringing about a shortening of the flight path.

8 Claims, 3 Drawing Sheets

SHORT-RANGE PROJECTILE CONTAINING MEANS FOR PRODUCING A SHORT FLIGHT PATH

BACKGROUND OF THE INVENTION

The present invention broadly relates to ammunition for training practice and, more specifically, pertains to a short-range projectile or shell containing means for producing the short range of the projectile or shell during travel of the projectile or shell along its flight path.

A short-range projectile known to the art and disclosed, for example, in Swiss Patent No. 532,240, published Feb. 15, 1973, which is cognate with U.S. Pat. No. 3,747,533, granted Jul. 24, 1973 and European Published Patent Application No. 0,036,232, published Sept. 23, 1981, comprises a projectile body and a projectile nose or tip which separates or is released during flight of the short-range projectile. A portion of the projectile nose or tip is made of heat-sensitive material which melts under the action of air resistance or drag in the airstream.

In another known short-range projectile containing means to destabilize the short-range projectile at the end of a first flight phase and disclosed, for example, in Swiss Patent No. 667,723, published Oct. 31, 1988, a destabilization body is mounted at the base or bottom of the short-range projectile. This destabilization body extends into a no-airstream space or dead-water zone at the rear or tail end of the short-range projectile and initiates destabilization as soon as the destabilization body projects out of the diminishing no-airstream space or dead-water zone.

The use of melting material has the disadvantage that the short-range projectile in summer at relatively high temperatures describes a different portion of the trajectory thereof than in winter at relatively low temperatures. The mounting of a destabilization body likewise does not render possible an accurate shortnning of the flight path in accordance with existing range limitation requirements.

SUMMARY OF THE INVENTION

Therefore, with the foregoing in mind, it is a primary object of the present invention to provide a new and improved construction of a short-range projectile or shell which does not suffer from the aforementioned drawbacks and shortcomings of the prior art constructions.

Another important and more specific object of the present invention is directed to providing a new and improved construction of a short-range projectile or shell or round which is particularly simple and economical to manufacture, without requiring any additional expenditure of time-consuming work for the means to produce a short flight path of the short-range projectile.

Now in order to implement these and still further objects of the present invention which will become more readily apparent as the description proceeds, the short-range projectile or shell or round of the present invention is manifested, among other things, by the features that the surface of the short-range projectile at least at preselected or predetermined locations comprises a material which is subject to change under the action of air friction during flight, in order to increase the air resistance or drag.

The short-range projectile or shell advantageously comprises a projectile or shell nose or tip formed of suitable plastic material, the surface of the projectile or shell nose or tip being subject to change in flight to such an extent that the air resistance or drag increases and the flight path of the short-range projectile or shell is shortened.

The surface of this projectile or shell nose or tip, which surface is formed of suitable plastic material, is heated during launch and subsequent flight until the short-range projectile or shell reaches the maximum operating distance.

The prevailing thermal influences, such as conduction of heat and heat transfer to the material, affect the projectile or shell nose such that centrifugal forces change or alter the structure and thus increase surface roughness. There is thereby partially effected a removal of surface material under eroding action. This, in turn, brings about an accurately defined shortening of the remaining flight path, particularly in the subsonic range.

The short-range projectile or shell can also advantageously comprise at the surface thereof a suitable layer or coating which during flight of the short-range projectile or shell is subject to considerable change under the action of air friction by the airstream, such that the air resistance or drag substantially increases and the flight path of the short-range projectile or shell is shortened. This layer or coating is preferably provided at the front or fore-part surface of the short-range projectile or shell and produces, in fact, the same effect as the short-range projectile or shell nose formed of suitable plastic material.

For the aforesaid plastic material of the projectile or shell nose and for the layer or coating of the short-range projectile or shell there is preferably used polycarbonate.

In a further exemplary embodiment of the short-range projectile or shell containing means for producing a short flight path, the surface of the short-range projectile or shell is subject to roughening under the action of air friction during travel of the short-range projectile or shell along its flight path.

According to a further embodiment the surface of the short-range projectile or shell is roughened and then appropriately smoothened by a layer or covering of suitable plastic material, which layer or covering disappears or disintegrates under the action of air friction during flight of the short-range projectile or shell.

In accordance with a still further construction, the surface of the short-range projectile or shell can be provided with grooves or furrows or the like which are appropriately covered by a layer or covering of suitable plastic material, which layer or covering disappears or disintegrates under the action of air friction by the airstream during travel of the short-range projectile or shell along its flight path.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that in order to simplify the illustration thereof, only enough of the structure of the short-range projectile or shell, also known in the art as a short-range practice or training-practice round, has been illustrated therein as is needed to enable one skilled in the art to readily understand the underlying principles and concepts of this invention.

Figure 1:
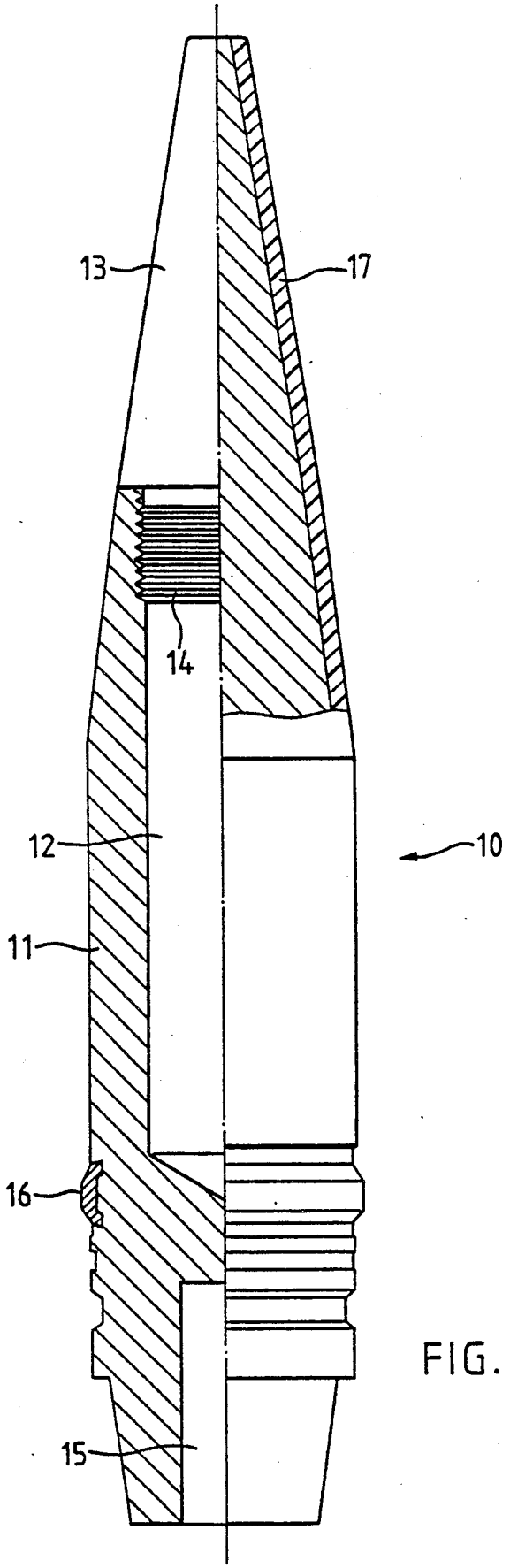
FIG. 1 is a longitudinal axial sectional view through a short-range projectile or shell containing means for producing a short flight path and constructed according to the teachings of the present invention.

Turning attention now specifically to FIG. 1 of the drawings, the structure illustrated therein by way of example and not limitation will be seen to comprise a short-range projectile or shell or round 10 containing a projectile or shell body 11 which at the front or nose end thereof is provided with a substantially axial tapped blind-end bore or blind hole 12. In this tapped blind-end bore 12 there is inserted a projectile or shell nose or tip 13 which is retained in the tapped blind-end bore 12 by means of an appropriate thread 14. The projectile or shell body 11 comprises at the rear or tail end thereof a blind-end bore or blind hole 15, in which, for example, there can be inserted a tracer flare. Furthermore, the projectile or shell body 11 is provided with a spin or guide band 16.

This short-range projectile or shell or round 10 is essentially constructed in the same manner as a normal or full-range projectile or shell, and differs solely in that there are provided means for producing the short range of the short-range projectile or shell 10 during travel thereof along its flight path.

The deviation of the flight path of such a short-range or practice projectile or shell 10 from the flight path of the related normal or full-range projectile or shell should be smaller or less than 1% during the first 2,000 meters after launch. However, the flight path of the short-range or practice projectile or shell 10 should not coincide any longer than during 4,000 meters with the flight path of the related normal or full-range projectile or shell.

The exemplary embodiments of means for producing the short flight path of a short-range projectile or shell or round 10 during travel thereof in its flight path are hereinafter described:

(a) The projectile or shell nose or tip 13 is formed of a suitable plastic material. Preferably, this plastic material for the projectile or shell nose or tip 13 is a polycarbonate. With such material, the surface roughness of the projectile tip 13 is subject to change under the action of air friction during flight of the short-range projectile or shell 10 to such an extent that the air resistance or drag of the short-range projectile or shell 10 increases and, accordingly, the flight path of the short-range projectile or shell 10 is considerably shortened, above all in the subsonic range.

(b) The projectile or shell nose or tip 13 formed, for example, of steel or aluminum is appropriately totally or partially coated with a layer 17 of suitable plastic material, or the entire projectile or shell body 11 is coated totally or partially at the surface thereof with a layer 17 of suitable plastic material. The surface roughness of this layer 17 of suitable plastic material is subject to change under the action of air friction during flight of the short-range projectile or shell 10 to such an extent that the air resistance or drag of the short-range projectile or shell 10 increases and the flight path thereof is considerably shortened.

Figure 2:
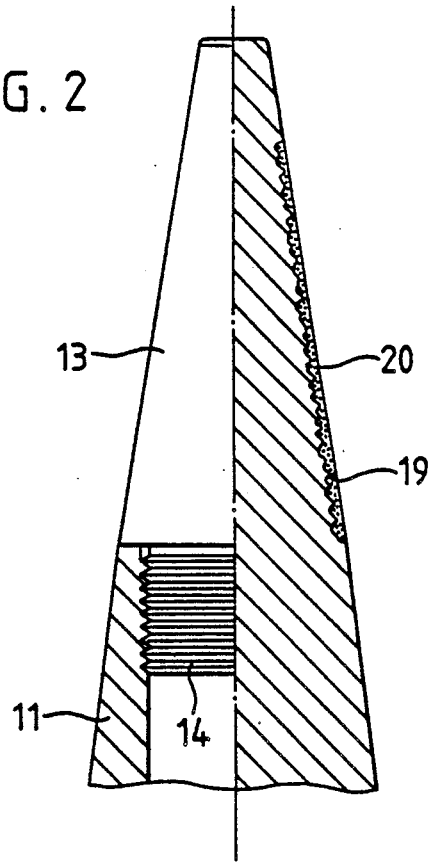
FIG. 2 illustrates in fragmentary sectional view the nose or tip of a short-range projectile or shell containing a further exemplary embodiment of means for producing a short flight path and constructed according to the teachings of the present invention.
Figure 3:
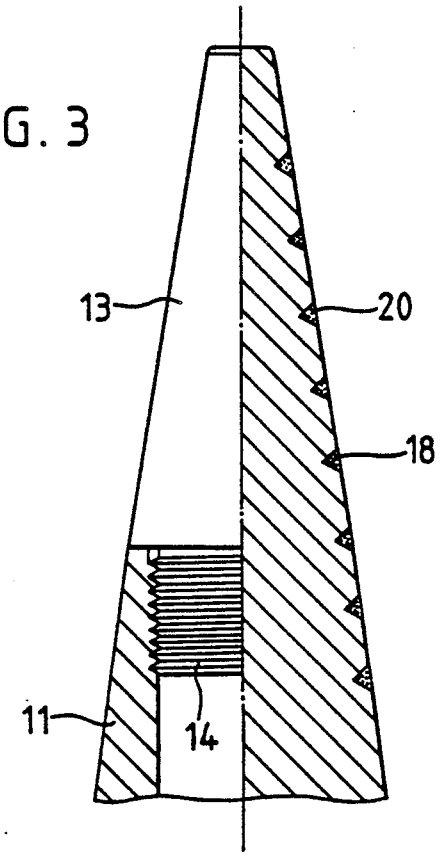
FIG. 3 illustrates in fragmentary sectional view the nose or tip of a short-range projectile or shell containing a still further exemplary embodiment of means for producing a short flight path and constructed according to the teachings of the present invention.

(c) The surface of the short-range projectile or shell 10 is roughened in a defined manner as shown in FIG. 2, or provided, for example, with grooves or furrows 18 or the like, as shown in FIG. 3. Such projectile or shell 10 is then covered with a layer or coating 20 of suitable plastic material until the roughened surface 19 or the surface provided with the grooves or furrows 18 is again absolutely smooth. This layer or coating 19 or 20 of suitable plastic material is structured such that the same is subject to erosion under the action of air friction during flight of the short-range projectile or shell 10 and the roughened surface 19 or the surface provided with the grooves or furrows 18 or the like determines the air resistance or drag of the short-range projectile or shell 10. This air or aerodynamic resistance or drag is then of such magnitude, that the range of the short-range projectile or shell 10 is considerably reduced, i.e. substantially short of the range of the related normal or full-range projectile or shell.

Figure 4:
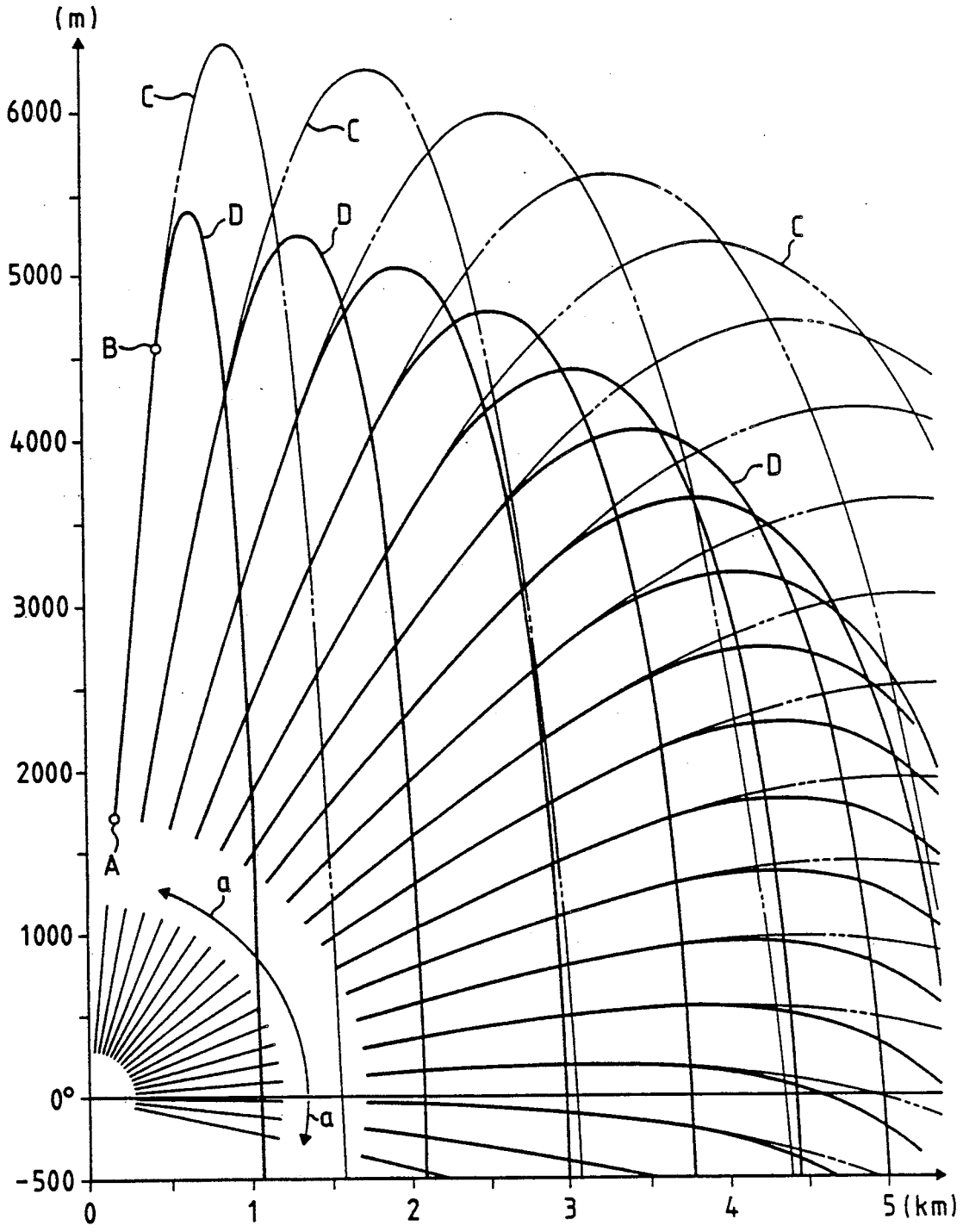
FIG. 4 is a flight-path chart showing trajectories described by the short-range projectile or shell and by the related full-range projectile or shell at different elevations of the barrel of a related weapon.

The shortening of the flight path of the short-range or practice projectile or shell 10 relative to the flight path of the related normal or full-range projectile or shell is illustrated in the flight-path chart in FIG. 4. For each elevation a of the related barrel of a suitable weapon not particularly shown in the drawings, there are illustrated two flight paths of the respective projectile or shell. These two flight paths for each associated gun barrel elevation a coincide with one another along a path A-B. The normal flight path of a normal or full-range projectile or shell is conveniently designated by the reference character C, while the shortened flight path of the short-range or practice projectile or shell 10 is conveniently designated by the reference character D. This shortened flight path D results or follows from the change of the projectile surface under the action of air friction during launch and subsequent flight along the flight path A-B. As can be seen in FIG. 4, the length of this flight path A-B is a function of the elevation a of the barrel of a related weapon.

While there are shown and described present preferred embodiments of the invention, it is to be distinctly understood that the invention is not limited thereto, but may be otherwise variously embodied and practiced within the scope of the following claims.

Accordingly, what I claim is:

1. A short-range projectile comprising:

a projectile body;

means for producing a short range of the projectile during travel of the projectile along a flight path thereof;

said means for producing the short range comprising a projectile surface subject to air friction during flight of the projectile;

said projectile surface having preselected locations;

at least said preselected locations having a surface which is subject to change under the action of said air friction during flight and which surface change results in an increase of air resistance for the short-range projectile; and one of said preselected locations of said projectile surface constituting a projectile nose which remains affixed to said projectile body throughout flight of the short-range projectile.

2. The short-range projectile as defined in claim 1, wherein:

one of said preselected locations of said projectile surface constituting a projectile nose surface formed of a plastic material.

3. A short-range projectile comprising:

means for producing a short range of the projectile during travel of the projectile along a flight path thereof;

said means for producing a short range comprising a projectile surface subject to air friction during flight of the projectile;

said projectile surface having preselected locations;

said projectile surface being formed at least at said preselected locations of a material which is subject to change under the action of said air friction during flight, in order to increase air resistance for the short-range projectile;

said projectile surface comprising a layer; and said layer being subject to change during flight under the action of said air friction to such an extent that the air resistance increases and the flight path is shortened.

4. The short-range projectile as defined in claim 2, wherein:

said plastic material for said projectile nose surface is a polycarbonate.

5. The short-range projectile as defined in claim 3, wherein:

said layer at said projectile surface is formed of a polycarbonate.

6. The short-range projectile as defined in claim 3, wherein:

said projectile surface at least at said preselected locations thereof is subject to roughening under the action of said air friction during flight.

7. A short-range projectile comprising:

means for producing a short range of the projectile during travel of the projectile along a flight path thereof;

said means for producing the short range comprising a projectile surface subject to air friction during flight of the projectile;

said projectile surface having preselected locations;

said projectile surface being formed at least at said preselected locations of a material which is subject to change under the action of said air friction during flight, in order to increase air resistance for the short-range projectile;

said projectile surface being roughened at least at said preselected locations;

said roughened projectile surface being smoothened by means of a layer of plastic material; and said layer of plastic material disappearing under the action of said air friction during flight.

8. A short-range projectile comprising:

means for producing a short range of the projectile during travel of the projectile along a flight path thereof;

said means for producing the short range comprising a projectile surface subject to air friction during flight of the projectile;

said projectile surface having preselected locations;

said projectile surface being formed at least at said preselected locations of a material which is subject to change under the action of said air friction during flight, in order to increase air resistance for the short-range projectile;

said projectile surface being provided with grooves at least at said preselected locations;

said grooves being covered by means of a layer of plastic material; and said layer of plastic material disappearing under the action of said air friction during flight.

* * * * *